US006681964B2

(12) United States Patent
Renard et al.

(10) Patent No.: US 6,681,964 B2
(45) **Date of Patent: *Jan. 27, 2004**

(54) GROOVED REFRACTORY POURING TUBE FOR METALLURGICAL CASTING, ASSEMBLY OF REFRACTORY COMPONENTS, CASTING INSTALLATION AND PROCESS FOR REPAIRING THE SURFACE OF A REFRACTORY COMPONENT

(76) Inventors: Jean-Luc Renard, 27, rue Arthur Duquesne, B-7030, Saint-Symphorien (BE); Luigi Borgosano, 177, rue du Bout de la Haut, B-7390, Quaregnon (BE)

( * ) Notice: Subject to any disclaimer, the term of this patent is extended or adjusted under 35 U.S.C. 154(b) by 0 days.

This patent is subject to a terminal disclaimer.

(21) Appl. No.: 10/221,083

(22) PCT Filed: Mar. 5, 2001

(86) PCT No.: PCT/BE01/00036

§ 371 (c)(1),
(2), (4) Date: Sep. 6, 2002

(87) PCT Pub. No.: WO01/66285

PCT Pub. Date: Sep. 13, 2001

(65) Prior Publication Data

US 2003/0038410 A1 Feb. 27, 2003

(30) Foreign Application Priority Data

Mar. 7, 2000 (EP) ..... 00870038

(51) Int. Cl.[7] ..... B22D 41/08

(52) U.S. Cl. ..... 222/606; 222/600

(58) Field of Search ..... 222/590, 600, 222/603, 606, 607

(56) References Cited

U.S. PATENT DOCUMENTS

| | | | | | |
|---|---|---|---|---|---|
| 3,887,117 | A | | 6/1975 | Fehling | |
| 4,576,317 | A | | 3/1986 | Wenger | |
| 5,390,902 | A | * | 2/1995 | Szadkowski | 222/603 |
| 5,670,075 | A | * | 9/1997 | Vassilicos | 222/603 |
| 5,866,022 | A | * | 2/1999 | Hall | 222/600 |

FOREIGN PATENT DOCUMENTS

| | | | | | |
|---|---|---|---|---|---|
| FR | 2757431 | A | | 6/1998 | |
| JP | 2-235565 | A | | 9/1990 | |
| JP | 405008021 | A | * | 1/1993 | |
| JP | 405115964 | A | * | 5/1993 | 222/600 |
| WO | WO 92/20480 | A1 | | 11/1992 | |

* cited by examiner

*Primary Examiner*—Scott Kastler
(74) *Attorney, Agent, or Firm*—James R. Williams; Robert S. Klenz, Jr.; Donald M. Satina

(57) ABSTRACT

The object of the present invention is a refractory pouring tube including a contact face (15) capable of bearing against a contact face (11) of another refractory component (9), the said pouring tube being arranged to be displaced. The said pouring tube is characterised by the fact that its contact face (15) incorporates a cleaning groove (26, 27) delineated notably by a wall presenting an edge capable of exerting a scraping action, as the said pouring tube is displaced, at least partially on the determinate part of the contact face of the other refractory component. The cleaning groove makes it possible to preserve the integrity of the contact surface of the other refractory component and, consequently, the joint surface formed between the two components.

8 Claims, 3 Drawing Sheets

GROOVED REFRACTORY POURING TUBE FOR METALLURGICAL CASTING, ASSEMBLY OF REFRACTORY COMPONENTS, CASTING INSTALLATION AND PROCESS FOR REPAIRING THE SURFACE OF A REFRACTORY COMPONENT

The present invention relates to a grooved refractory component and more particularly to a refractory pouring tube for metallurgical casting, and assembly of refractory components, a casting installation and a process for repairing the contact face of a refractory component.

It is known that the casting of steel calls for the filling of successive metallurgical vessels, notably a ladle, a tundish and ingot moulds, and that during its passage from one upper metallurgical vessel to a lower metallurgical vessel, the metal must as far as possible be kept out of all contact with the ambient air.

To this end, a pouring shroud or a submerged entry nozzle made of refractory material forms an extension to the pouring orifice of the upper vessel (respectively the ladle or tundish), and enters the molten metal present in the lower vessel (respectively the tundish or ingot mould), so that the molten metal passes from the ladle to the tundish or from the tundish to the ingot mould without ever being exposed to the ambient air.

The pouring orifice of the upper vessel incorporates an inner nozzle in refractory material, which opens below this vessel via a contact surface designed to mate with a contact surface on the pouring shroud or submerged entry nozzle, thereby forming a joint face between these two components.

Conventionally, a casting installation also includes means of regulating the flow of the molten metal. These means may consist of a stopper rod which enters the metal bath of the upper vessel opposite the pouring orifice and whose degree of immersion in the said metal bath determines the opening of the said pouring orifice. Alternatively, use may also be made of a slide valve incorporating a set of refractory plates each having an orifice. These plates are normally located between the inner nozzle and the pouring shroud or the submerged entry nozzle. The degree of alignment of the orifices in adjacent plates determines the flow of molten metal.

A continuous casting installation therefore includes numerous assembled refractory components, the interfaces between which are formed by contact surfaces that may be planar or non-planar, as indicated for example in document U.S. Pat. No. 5,984,153.

It is known that the reductions in cross-section which occur along the molten metal pouring channel produce considerable negative pressure which can in turn lead to an induction of air.

The joint surface is generally effective in avoiding air induction problems, but it has been found that it has a tendency to deteriorate at each replacement of the pouring shroud or submerged entry nozzle.

This replacement can be carried out, in a known manner, by positioning a new tube beside the tube to be replaced, then simultaneously moving the two tubes, allowing the new tube to displace the old one and take its place beneath the inner nozzle.

Prior to each replacement, the tundish pouring orifice is closed off, but it is possible for droplets of molten metal to remain at the joint surface, at the interface between the pouring orifices of the tube and the inner nozzle. These droplets, which solidify, are drawn into the joint surface and cause more or less severe damage to the contact face of the inner nozzle. As it is not possible to replace the inner nozzle during casting, it is essential to preserve the integrity of this nozzle and in particular its lower contact face, so that the sealing tightness of the joint surface formed with the contact face of the tube is maintained for as long as possible and so that, consequently, the casting operation need not be prematurely interrupted.

This problem is further exacerbated if the joint surface incorporates an injection channel for a fluid, such as an inert gas, which may have the function both of preventing the ingress of ambient into the joint surface and/or allowing the injection of a sealing agent into the joint surface (as shown in documents WO 98/17420 and WO 98/17421, in order to treat the cracks which invariably propagate on the contact face of the inner nozzle and the score marks or scratches produced during tube changes.

The droplets of metal trapped at the joint surface accumulate in the injection channel and can cause it to become obstructed, thereby rendering it ineffective both in terms of preventing the admission of ambient air and in terms of the treatment of cracks and score marks or scratches.

When the tube is moved for the purposes of replacement, the extraneous material obstructing the injection channel is sheared between the two contact faces and spreads notably over part of the contact face of the inner nozzle.

The aim of the present invention is to remedy these problems in a simple and economic manner.

The object of the present invention is a refractory pouring tube forming part of a pouring channel and including at least one contact face capable of bearing against a contact face of another refractory component forming an adjacent portion of the pouring channel, the said pouring tube being arranged to be displaced in a predefined trajectory along which its contact face slides and remains in bearing contact against the contact face of the other refractory component, the said pouring tube being characterised in that its contact face incorporates a cleaning groove delineated notably by a wall presenting an edge capable of exerting a scraping action, as the said pouring tube is displaced, at least partially on the determinate part of the contact face of the other refractory component.

The pouring tube which is the object of the invention can be for example a submerged entry nozzle or pouring shroud.

It is to be understood that, as it passes over the contact face of the other refractory component, the cleaning groove picks up all of the extraneous material accumulated on the latter, and notably any metal droplets entrained during the relative movement of the two refractory components.

Thus, for a refractory pouring tube whose replacement is effected by simultaneous movement of the said pouring tube and its replacement pouring tube which displaces the former and takes its place in the working position, the cleaning groove is found to be highly effective in clearing the joint surface of all dirt and extraneous matter such as metal droplets entrained during the movement of the two refractory components. Depending on whether the cleaning groove is located ahead of or behind the pouring channel in relation to the direction of movement of the two components, the refractory pouring tube performs the scraping action for itself when it replaces a previous refractory pouring tube, or for a succeeding refractory pouring tube when the said refractory pouring tube is replaced by the next refractory pouring tube.

In a preferred embodiment of the invention, the cleaning groove is positioned so that the cleaning edge is able to scrape the entirety of the determinate part of the contact face of the other refractory component.

One possibility to achieve this purpose is for the cleaning groove to be located behind the pouring channel in relation to the direction of movement of the refractory pouring tube, so that it passes over the determinate part of the contact face from its border with the pouring orifice up to its edge. In this case, the cleaning groove exerts its action not for the refractory pouring tube in which it is incorporated, but for its replacement.

According to a particular characteristic of the invention, the cleaning groove is blind. Preferably, the cleaning groove should have a width such that, when the groove is at the level of the pouring orifice (for example when the tube is changed), it does not communicate with the injection groove. Thus, if some molten metal remains at the interface between the pouring orifices of the inner nozzle and the submerged entry nozzle, it will not reach the injection groove. Therefore, according to an advantageous characteristic of the invention, the cleaning groove is shorter than the minimum width between opposite sections of the injection groove on either side of the pouring orifice at the level of the pouring orifice.

In a particular embodiment of the invention, the contact face of the refractory pouring tube incorporates a second groove essentially parallel to the cleaning groove.

This second groove may be located, relative to the first groove, on the other side of the pouring channel. It may even be symmetrical with the cleaning groove relative to the pouring channel, which is particularly advantageous if the refractory pouring tube can be used in two possible positions, by virtue of its own axial symmetry, as is the case with certain pouring shrouds or submerged entry nozzles.

In a particular embodiment of the invention, the second groove partially covers an injection groove in the other refractory component defining an injection channel.

The second groove then performs a different function from the cleaning groove, namely that it allows a fluid injected into the injection channel to bypass a part of the said channel which may be blocked.

In order to avoid obstruction of the inlet or outlet of the injection channel, notably by a sealing agent carried by the injected fluid, the second groove may be formed so as to cover the opening of a delivery line and, where appropriate, discharge line of the fluid injection channel.

In a particular embodiment of the invention, the refractory pouring tube incorporates several grooves capable of scraping at least partially the determinate part of the contact face of the other refractory component.

The object of the present invention is also an assembly of refractory components forming a pouring channel and each incorporating at least one contact face bearing against the contact face of another adjacent refractory component, characterised in that one of the refractory components is a refractory pouring tube as described above.

In a particular embodiment of this assembly, the other refractory component incorporates an injection groove which forms an injection channel with the contact face of the refractory pouring tube incorporating the cleaning groove, into which injection channel emerges a delivery line and, where appropriate, discharge line provided in one or more of the refractory components.

The object of the present invention is also a casting installation including an upper metallurgical vessel and a lower metallurgical vessel connected by a pouring channel defined notably by an assembly of refractory components as described above.

According to a particular characteristic, the assembly of refractory components is equipped with an injection channel and the casting installation includes a fluid source connected to the delivery line of the fluid injection channel.

According to an additional characteristic, the casting installation also includes a means of injecting a sealing agent, for example powdered graphite, into the fluid.

A further object of the present invention is a process for repairing the contact face of a refractory component forming part of a pouring channel, the said contact face being capable of serving as a bearing surface for a contact face of another refractory component (i.e. a pouring tube) forming an adjacent part of the pouring channel, the said other component being arranged to be displaced in a pre-defined trajectory along which its contact face slides and remains in bearing contact against the contact face to be repaired, whilst the portion of the pouring channel formed by the said other component defines a determinate part of the contact face to be repaired, the process being characterised in that, as the pouring tube is displaced, the determinate part of the contact face to be repaired is scraped at least partially by the cleaning groove formed on the contact face of the said pouring tube and delineated notably by a wall presenting an edge suitably shaped for this purpose.

In order to better explain the invention, a mode of implementation given by way of example which does not limit the scope of the invention will be described below with reference to the attached diagram in which:

BRIEF DESCRIPTION OF THE DRAWINGS

FIG. 1 shows the bottom wall 1 of a tundish, in a region surrounding one of its pouring orifices 2.

Figure 1:
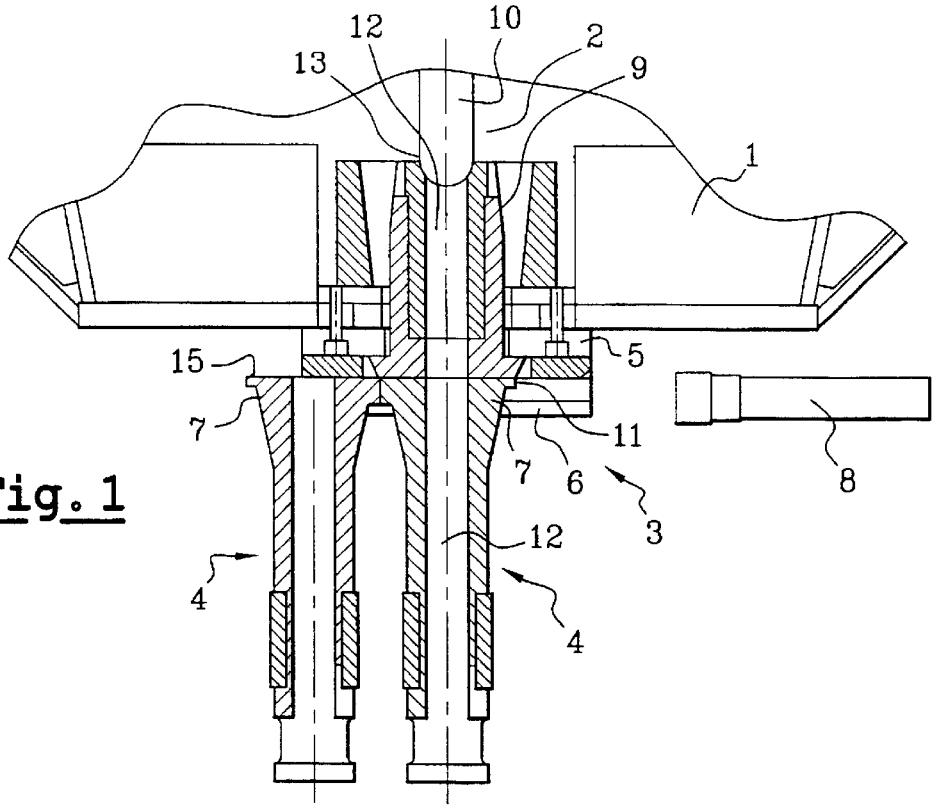
FIG. 1 is an axial cross-section of an inner nozzle of a tundish and a submerged entry nozzle.

The tundish is fitted with a device 3 for changing the tube 4 which includes a mounting plate 5 integral with the bottom wall of the tundish, guide-rails 6 accommodating the collars 7 of two submerged entry nozzles which are thus held in proximity to the mounting plate 5, and a cylinder 8 to push the two submerged entry nozzles 4 in the guide-rails.

The pouring orifice 2 of the tundish is lined with an inner nozzle 9 made of refractory material, which passes through the mounting plate 5 and bears on the lower face of the latter by means of a flat contact face 11.

The guide-rails 6 hold the two submerged entry nozzles 4 against the contact face 11 of the inner nozzle at an elevated pressure equivalent to a weight of several tonnes.

In FIG. 1, the submerged entry nozzle 4 on the right is the one which forms, in conjunction with the inner nozzle 9, a portion of the pouring channel 12 for the molten metal. The nozzle to the left is the one which has just been replaced by moving in the guide-rails 6 under the action of the cylinder 8.

A stopper rod 10 can be applied against the upper orifice 13 of the inner nozzle to regulate the metal flow or to interrupt pouring, notably to allow replacement of the submerged entry nozzle.

Figure 2:
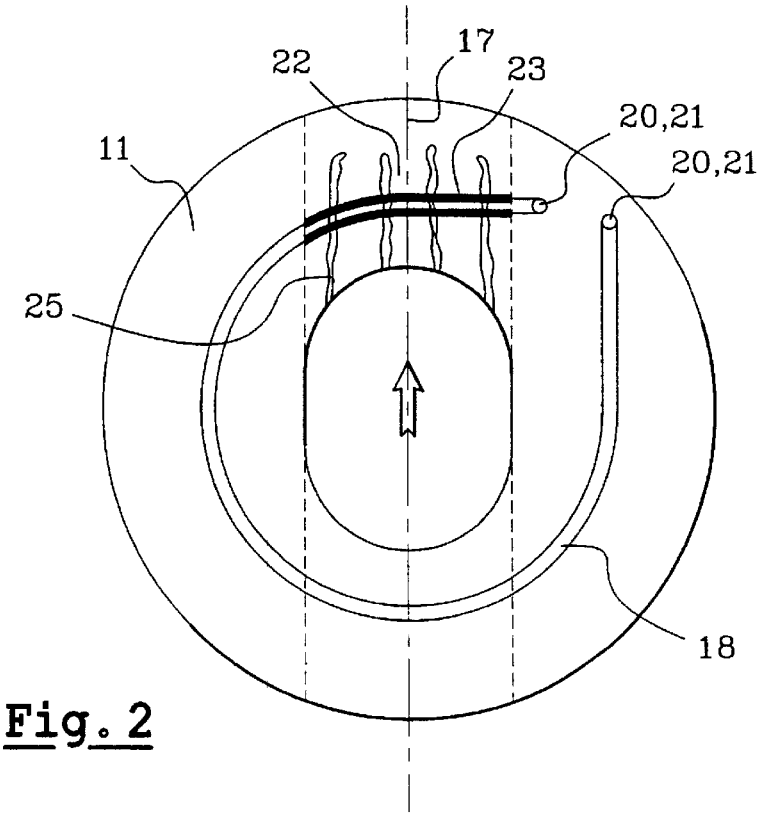
FIG. 2 is a view on the underside of the contact face of the inner nozzle.

FIG. 2 illustrates the contact face 11 of the inner nozzle.

The pouring orifice has an elongated cross-section oriented in a direction 17 which is parallel to the guide-rails 6, i.e. the direction in which the submerged entry nozzles are moved when the older of the two nozzles is being replaced.

Around the pouring orifice, the contact face incorporates an injection groove 18 in the form of a three-quarter partial circle extending into straight sections of which the ends 20 are close together but which are not in communication with each other. One end 20 communicates with the outlet 21 of a delivery line, or respectively a discharge line, formed in the inner nozzle 9.

Figure 3:
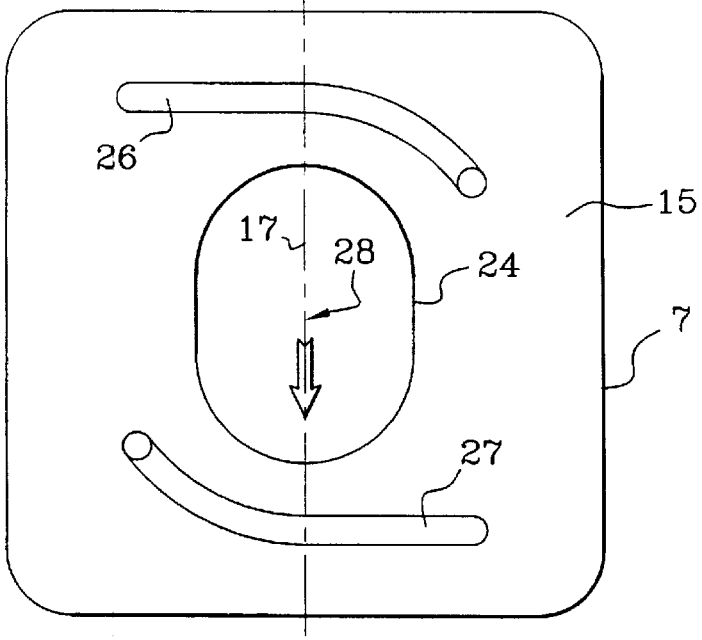
FIG. 3 is an upper view on the contact face of the submerged entry nozzle.

In FIG. 3, it can be seen that each submerged entry nozzle 4 delineates a portion 24 of elongated transverse cross-section (in direction 17) of the pouring channel, and that its collar 7 is rectangular in shape to enable it to be guided in the guide-rails 6 of the submerged entry nozzle changer 3.

The contact face 15 of each submerged entry nozzle, formed by the upper face (according to the orientation in FIG. 1) of its collar 7, covers the injection groove 18 of the inner nozzle 9 when the submerged entry nozzle 4 is in the working position, and thus forms an injection channel for fluid and/or sealing agent to prevent the admission of ambient air into the pouring channel and/or to prevent damage to the refractory material constituting the inner nozzle around its cracks or score marks 25.

When the submerged entry nozzle 4 is replaced, the contact faces 15 of the two submerged entry nozzles slide in the direction 17 against the contact face 11 of the inner nozzle.

Droplets of molten metal present around the pouring channel, at the interface between the inner nozzle and the submerged entry nozzle, i.e. at the joint surface, are entrained by the submerged entry nozzle into a determinate part 22 of the contact face of the inner nozzle located behind the pouring orifice in the direction of movement of the submerged entry nozzles.

These droplets of metal have two deleterious effects.

Firstly, they foul this determinate part 22 by preventing proper surface contact to be established between the contact faces of the inner nozzle and the submerged entry nozzle.

The second deleterious effect is that they accumulate in a portion 23 (marked by a thick line in FIG. 2) of the injection groove corresponding to the intersection of the said injection groove with the said determinate part 22, and give rise to blockage of the injection channel during subsequent use of the replacement submerged entry nozzle.

The blockage which occurs during the use of the nozzle as it is being replaced is itself a damaging factor, as the extraneous material constituting the obstruction is sheared between the contact faces of the inner nozzle and the submerged entry nozzle, and is entrained into the determinate part 22.

Two cleaning grooves 26 and 27 are formed in the contact face 15 of each submerged entry nozzle 4. Each of these is delimited by an edge whose form is determined so as to scrape the contact face of the inner nozzle and to remove all extraneous material which is trapped there. The person skilled in the art can determine a more or less sharp configuration for this edge to achieve optimum scraping.

The cleaning grooves are positioned so as to scrape at least partially, as the submerged entry nozzle is displaced in the guide-rails, the determinate part 22 of the contact face of the inner nozzle.

In the example shown, the two cleaning grooves 26 and 27 are centrally symmetrical about the centre 28 of the contact face, which essentially coincides with the centre of the transverse cross-section of the pouring channel, by the fact that each submerged entry nozzle can be used in the two possible positions of engagement of its rectangular collar 7 in the guide-rails 6.

In reality, only the cleaning groove 26 located ahead of the pouring channel performs the cleaning function on the contact face 11 of the inner nozzle, for the replacement nozzle.

In effect, when the cleaning groove 26 of the submerged entry nozzle being replaced arrives at the vertical of the determinate part 22 of the contact face 11 of the inner nozzle, it scrapes it and leaves behind a clean surface ensuring good quality contact between the inner nozzle and the contact face of the replacement submerged entry nozzle.

If, despite the scraping action performed by the submerged entry nozzle which has been replaced, the portion 23 of the injection groove becomes blocked during use of the replacement submerged entry nozzle, the fluid delivered into the injection channel can bypass the blocked section of the injection groove 18 by circulating through the second groove 27 (which, in the position that it occupies, does not perform a cleaning function, as already indicated) of the submerged entry nozzle. The second groove 27 communicates with the injection groove 18 on both sides of its obstructed section 23. The fluid can thus reach the rest of the injection channel to act as prescribed against the ingress of air and/or to treat cracks.

Beyond its circular section covering the determinate part 23 of the injection groove, the second groove 27 extends into a straight length which covers the straight section of the injection groove.

Thus, the second groove clears not only that part of the injection groove liable to be obstructed, but it also clears the opening 21 of its delivery line, so that the sealing agent, if it is carried by the fluid, has a sufficient volume upon its arrival in the injection channel not to congeal and block the channel at its inlet.

Figure 5:
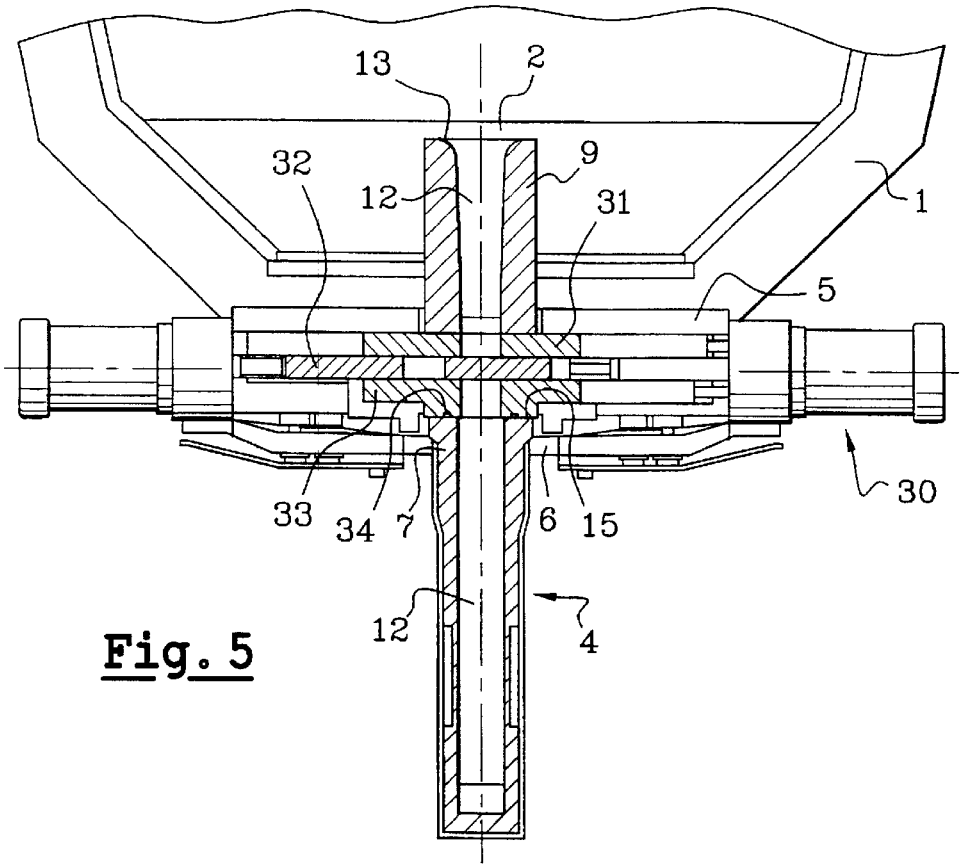
FIG. 5 is a view similar to FIG. 1 showing a slide valve interposed between the inner nozzle and the submerged entry nozzle.

The slide valve 30 in FIG. 5 is interposed between the inner nozzle 9 and the submerged entry nozzle 4 described previously.

This slide valve 30 is composed of a fixed upper plate 31, an intermediate mobile plate 32, and a fixed bottom plate 33.

Figure 4:
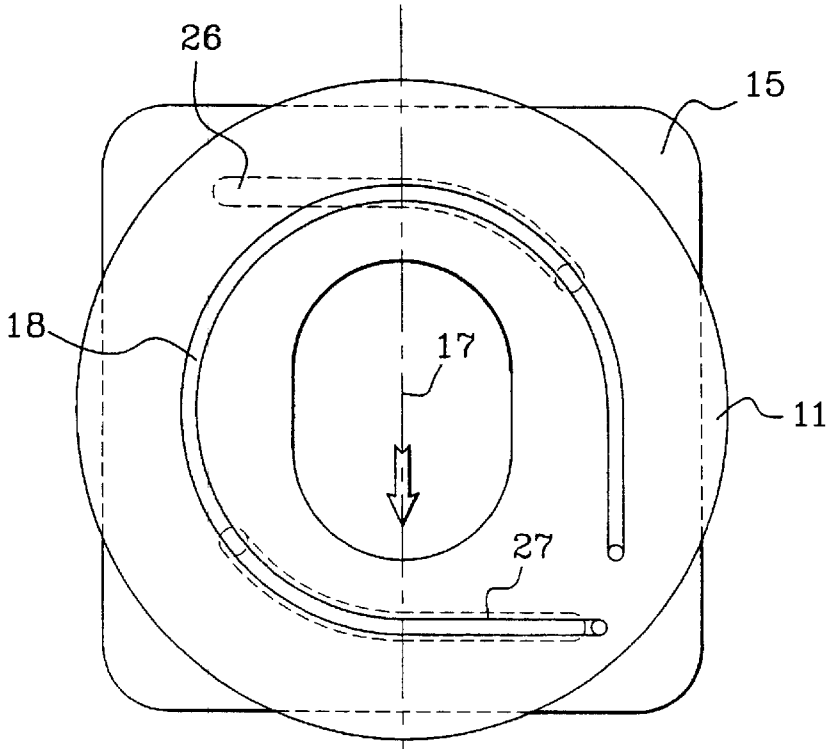
FIG. 4 shows the superimposed contact faces of the inner nozzle and the submerged entry nozzle.

As explained above, the inner nozzle 9 can incorporate an injection groove. In this case, the injection channel is formed with the upper face (relative to FIG. 4) of the fixed upper plate 31.

Other joint surfaces are formed between the fixed plates 31, 33 and the mobile plate 32 of the slide valve. As is known, other injection channels can be made in these joint surfaces to prevent the admission of air.

A joint surface is present between the fixed bottom plate 33 and the submerged entry nozzle 4 which poses the same risks of damage as that described in reference to FIGS. 1 to 4, by the fact that replacements of the submerged entry nozzle 4 cause friction and risks of obstruction of an injection groove 34 formed in the lower face (relative to FIG. 4) of the fixed bottom plate 33 which in conjunction with the contact face of the submerged entry nozzle forms a fluid injection channel.

By reason of this risk, the cleaning grooves 26 and 27 of a submerged entry nozzle identical to that in FIG. 3 fulfil the same functions with regard to the fixed bottom plate as in respect of the inner nozzle in FIG. 1.

Although the cleaning grooves have been described for submerged entry nozzles with reference to a flat joint surface at the outlet of a tundish, it is to be understood that the invention applies to any interface (planar or non-planar) between two refractory components forming a fluid injection channel between them.

Figure 6:
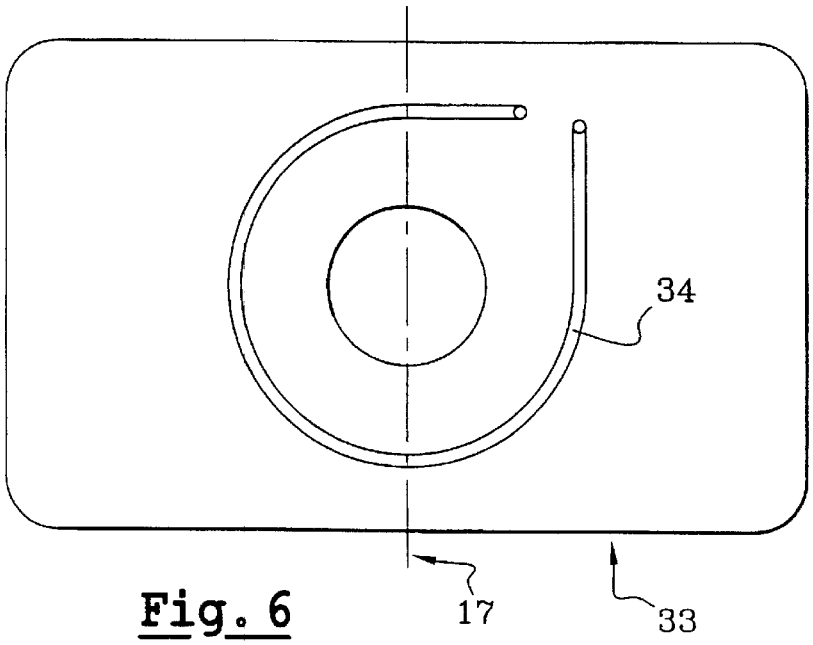
FIG. 6 is a view on the underside of the fixed bottom plate of the slide valve.

With regard to FIG. 6, reference will be made mutatis mutandis to the description of FIG. 2, and the reference 34 designates an injection groove formed in the lower face (relative to FIG. 5) of the fixed bottom plate.

1. tundish bottom wall
2. pouring orifice
3. tube changing device
4. submerged entry nozzle
5. mounting plate
6. guide-rails
7. tube collar
8. cylinder
9. inner nozzle
10. stopper rod
11. inner nozzle contact face
12. part of the pouring channel
13. upper orifice of the inner nozzle
15. submerged entry nozzle contact face
17. direction X
18. injection groove
20. groove ends
21. opening of a delivery line or discharge line, respectively
22. determinate part of the contact face of the inner nozzle
23. obstructed portion of the injection groove
24. portion of elongated transverse cross-section in direction X of the pouring channel of the submerged entry nozzle
25. cracks, score marks and scratches on the inner nozzle
26. cleaning groove
27. second groove
28. centre of the contact face of the submerged entry nozzle
30. slide valve
31. fixed upper plate
32. mobile intermediate plate
33. fixed bottom plate
34. injection groove formed in the lower face (relative to FIG. 5) of the fixed bottom plate

What is claimed is:

1. A refractory pouring tube defining a first portion of a pouring channel and comprising a first contact face adapted to be displaced relative to a second contact face of a second refractory component defining an adjacent portion of the pouring channel, whereby displacement comprises sliding the first contact face relative to while maintaining bearing contact against the second contact face and the first and second refractory components define an injection groove substantially encircling the pouring channel and having a determinate part behind the pouring channel relative to the displacement, the first contact face comprises a cleaning groove and a second groove, the cleaning groove presenting an edge adapted to scrape the second contact face as the pouring tube is displaced, the second groove is essentially parallel to the cleaning groove, and the second groove and the cleaning groove are on opposite sides of the pouring channel.

2. The refractory pouring tube of claim 1, wherein the cleaning groove is adapted to scrape the determinate part.

3. The refractory pouring tube of claim 1, wherein the pouring tube comprises a submerged entry nozzle.

4. The refractory pouring tube of claim 1, wherein the cleaning groove comprises a blind passageway.

5. A refractory pouring tube defining a first portion of a pouring channel and comprising a first contact face adapted to be displaced relative to a second contact face of a second refractory component defining an adjacent portion of the pouring channel, whereby displacement comprises sliding the first contact face relative to while maintaining bearing contact against the second contact face and the first and second refractory components define an injection groove substantially encircling the pouring channel and having a determinate part behind the pouring channel relative to the displacement, the first contact face comprises a cleaning groove and a second groove, the cleaning groove presenting an edge adapted to scrape the second contact face as the pouring tube is displaced, the second groove is essentially parallel to the cleaning groove and the second groove and the cleaning groove are symmetrical relative to the pouring channel.

6. The refractory pouring tube of claim 1, wherein the second groove is adapted to at least partially cover the injection groove, thereby forming an injection channel.

7. The refractory pouring tube of claim 1, wherein the injection groove includes an opening, and the second groove is adapted to cover the opening.

8. The refractory pouring tube of claim 1, wherein the pouring tube comprises a plurality of cleaning grooves.

* * * * *